US007151905B2

(12) United States Patent
Fiore et al.

(10) Patent No.: US 7,151,905 B2
(45) Date of Patent: Dec. 19, 2006

(54) ROLLER FOR SUPPORTING AN IMAGING BELT IN A PRINTING APPARATUS

(75) Inventors: Steven J. Fiore, Hilton, NY (US); Jennifer A. Kciuk, East Rochester, NY (US); Michael N. Soures, Webster, NY (US); Richard C. Dray, Jr., Rochester, NY (US); Michael L. Povio, Webster, NY (US); Gregory P. Mahoney, Victor, NY (US)

(73) Assignee: Xerox Corporation, Stamford, CT (US)

( * ) Notice: Subject to any disclaimer, the term of this patent is extended or adjusted under 35 U.S.C. 154(b) by 75 days.

(21) Appl. No.: 10/936,962

(22) Filed: Sep. 9, 2004

(65) Prior Publication Data

US 2006/0051132 A1 Mar. 9, 2006

(51) Int. Cl.
*G03G 15/00* (2006.01)

(52) U.S. Cl. ..... 399/162; 399/164

(58) Field of Classification Search ..... 399/162
See application file for complete search history.

(56) References Cited

U.S. PATENT DOCUMENTS

| | | | | | |
|---|---|---|---|---|---|
| 4,221,480 | A * | 9/1980 | Spehrley, Jr. | ..... | 399/165 |
| 4,872,247 | A * | 10/1989 | Nakamura et al. | ..... | 492/39 |
| 5,070,365 | A | 12/1991 | Agarwal | ..... | 355/212 |
| 5,273,227 | A * | 12/1993 | Smith, Jr. | ..... | 242/422 |
| 5,744,238 | A * | 4/1998 | Limperis et al. | ..... | 492/38 |
| 6,088,557 | A * | 7/2000 | Janssen et al. | ..... | 399/162 |
| 6,306,069 | B1 * | 10/2001 | Vesterlund | ..... | 492/39 |

* cited by examiner

*Primary Examiner*—David M. Gray
*Assistant Examiner*—Ryan D. Walsh
(74) *Attorney, Agent, or Firm*—R. Hutter

(57) ABSTRACT

A belt photoreceptor in a xerographic printer is entrained on a roller formed from a set of discs. Each disc defines an outer circumference and a flexible main portion. The outer circumferences of a set of discs effectively form a single outer surface of the roller. The discs are flexible and can move against each other, to allow stabilization of the photoreceptor belt, but are in sufficient contact with one another to enable heat to be distributed evenly across the roller.

17 Claims, 2 Drawing Sheets

FIG. 1 (PRIOR ART)
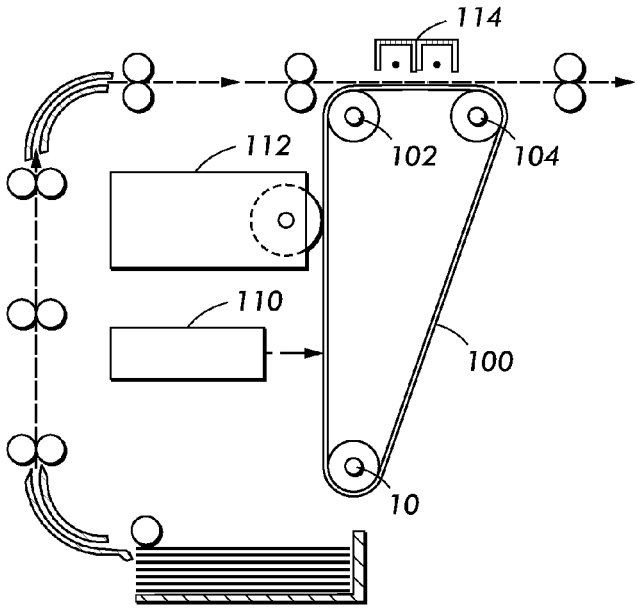
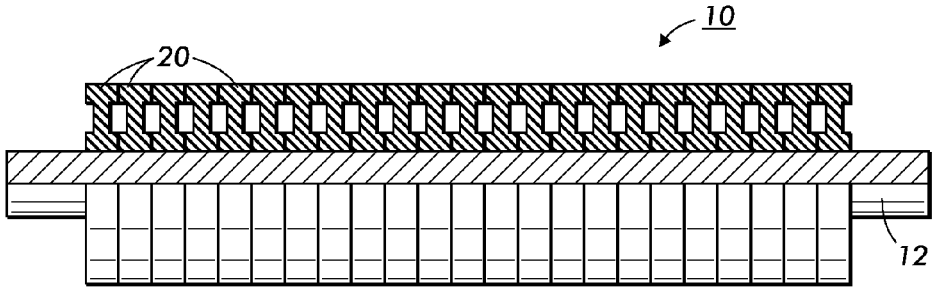
FIG. 2

ROLLER FOR SUPPORTING AN IMAGING BELT IN A PRINTING APPARATUS

TECHNICAL FIELD

The present disclosure relates to a roller for supporting a belt, such as for example an imaging belt used in a printing apparatus.

BACKGROUND

In the well-known process of electrophotography or xerography, a photoconductive member is charged to a substantially uniform potential so as to sensitize its surface. The charged portion of the photoconductive surface is exposed to a light image of an original document being reproduced. This records an electrostatic latent image on the photoconductive member corresponding to the informational areas contained within the original document being reproduced. After the electrostatic latent image is recorded on the photoconductive member, the latent image is developed by bringing toner particles into contact therewith. The toner particles are attracted to the latent image forming a toner powder image on the photoconductive member. The toner powder image is then transferred from the photoconductive member to a copy sheet. Finally, the copy sheet is heated to permanently affix the toner particles thereto in image configuration.

In a practical application, the location of the latent image recorded on the photoconductive belt must be precisely defined in order to have the various processing stations acting thereon optimize copy quality. To this end, it is critical that the lateral alignment of the photoconductive belt be controlled within prescribed tolerances. Only in this manner will the photoconductive belt move through a pre-determined path so that the processing stations disposed thereabout will be located precisely relative to the latent image recorded thereon.

When considering control of the lateral movement of a belt, it is well known that if the belt were constructed and entrained about perfectly cylindrical rollers mounted and secured in an exactly parallel relationship with one another, there would be no lateral movement of the belt. In actual practice, however, this is not feasible. Frequently the belt velocity vector is not normal to the roller axis of rotation, or the roller is tilted relative to the plane defined by the moving belt. Under either of these circumstances, the belt will move laterally relative to the roller until it is in a stable position. In any control system, it is necessary to prevent high local stresses which may result in damage to the highly sensitive photoconductive belt. Active systems, such as servo systems employing steering rollers apply less stress on the belt. However, active systems of this type are generally complex and costly. Passive systems, such as flanged rollers, are less expensive but generally produce high stresses.

Various types of flanged roller systems have hereinbefore been developed to improve the support and tracking of photoconductive belts. For example, the drive roller may have a pair of flanges secured to opposed ends thereof. If the photoconductive belt moves laterally, and engages one of the flanges, it must be capable of sliding laterally with respect to the drive roller to maintain its position. The edge force required to shift the belt laterally greatly exceeds the maximum tolerable edge force. Thus, the belt would start to buckle resulting in failure of the system. Belt edge forces are large because the drive roller has no lateral compliance.

Unless the approach angle of the belt, when it contacts the drive roller, is exactly zero, forces large enough to slide the belt with respect to the drive roller are generated. Thus, a system of this type is not always satisfactory for controlling lateral movement of a photoconductive belt in an electrophotographic printing machine.

U.S. Pat. No. 4,221,480 discloses a roller, on which a photoconductive belt is entrained, defining a series of disc-shaped members extending from a central core. The edge of each disc contacts the belt. Each disc has resilient properties and is spaced from adjacent discs by an appreciable distance along the roller. Small deformations of certain discs caused by lateral motion of the belt relative to the roller are counteracted by resilience of the discs, which has an effect of aligning the belt. One practical problem with the arrangement described in the '480 patent is that, under intense use, the discs act as heat sinks with greater effectiveness than the air between the discs, resulting in small temperature differentials between the disc-contacting and the non-contacting portions of the belt. In a xerographic context, these small differences in temperature result in differences in xerographic development performance. Prints made in the presence of these temperature differentials may exhibit stripes of varying image darkness along the direction of motion of the belt.

U.S. Pat. No. 3,070,365 discloses a roller for supporting a xerographic image receptor belt. The roller includes two oppositely-wound helical springs attached to the roller with an adhesive. The action of the two springs in the rotating roller aids in maintaining alignment of the image receptor belt.

SUMMARY

According to one aspect, there is provided a roller, comprising a plurality of discs, each disc defining a circumferential surface, a rim having a first thickness, and a flexible main portion. The circumferential surfaces of a plurality of discs form a substantially continuous surface.

According to another aspect, there is provided a printing apparatus, comprising a belt suitable for carrying marking material in imagewise fashion, and at least a first roller supporting the belt. The first roller includes a plurality of discs, each disc defining a circumferential surface and a flexible main portion. The circumferential surfaces of a plurality of discs form a substantially continuous surface.

BRIEF DESCRIPTION OF THE DRAWINGS

FIG. 1 is a simplified elevational view of selected elements of a printing apparatus, as generally familiar in the Prior Art.

FIG. 2 is a sectional, elevational view of a roller.

DETAILED DESCRIPTION

Figure 3:
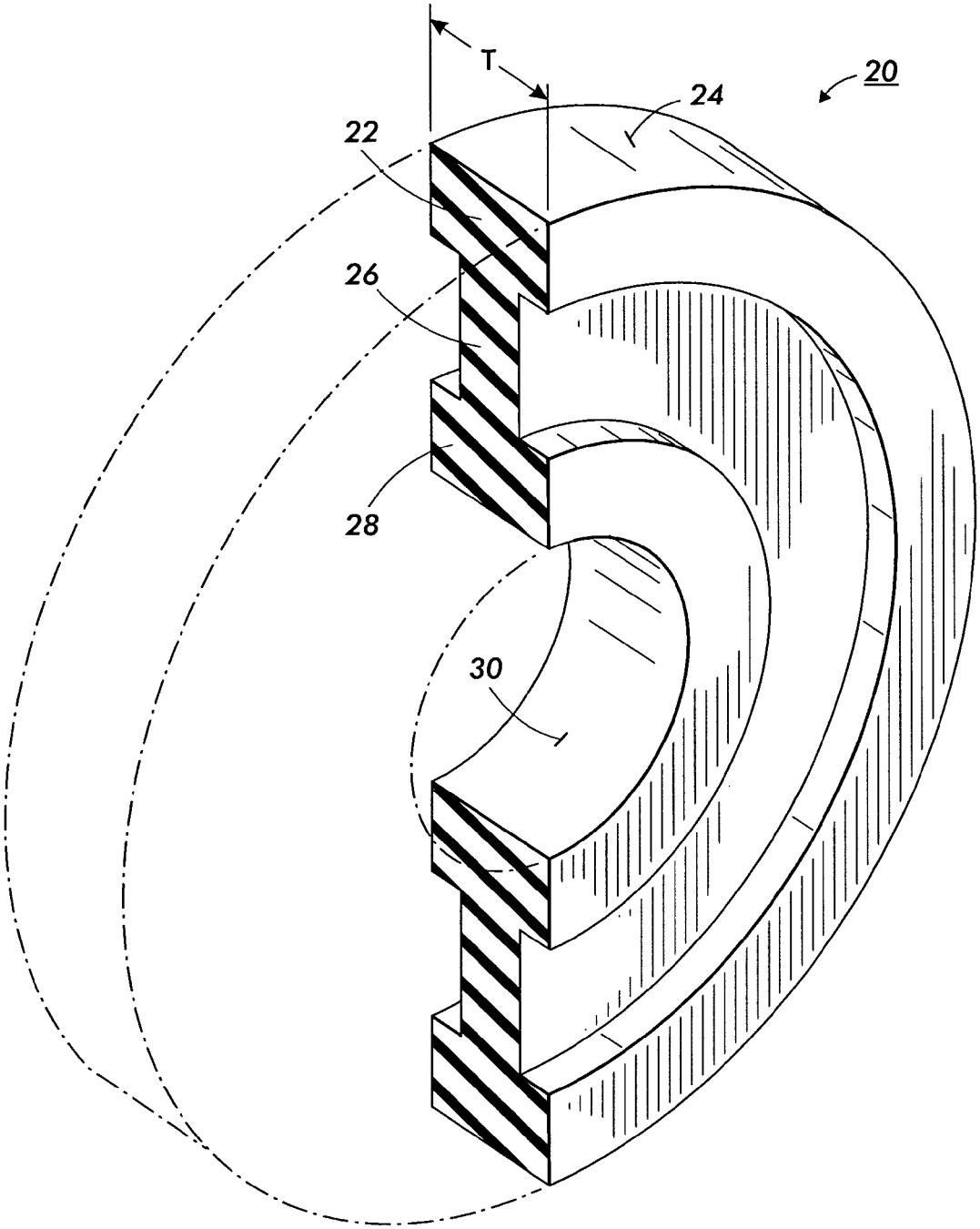
FIG. 3 is a sectional, perspective view of a single disc, used in a roller, in isolation.

FIG. 1 is a simplified elevational view of selected elements of a printing apparatus, in this case a xerographic "laser printer," as generally familiar in the Prior Art. There is provided a charge receptor belt 100, which is entrained around three rollers, in this case a drive roller 102, a stripper roller 104, and a tension roller 10. In this particular embodiment, belt 100 has a large wrap angle around tension roller 10. As is generally known in xerography, there are any number of stations around the path of belt 100, such as an exposure station 110 for exposing light onto the belt 10 to form an electrostatic latent image, a development station 112 for applying marking material, such as dry toner or liquid ink, to the belt 10, and a transfer station 114 for electrostatically transferring marking material carried on the belt to a print sheet (not shown). In other types of printing apparatus, such as offset or ink-jet, a belt may also be used for carrying marking material in an imagewise fashion for whatever purpose.

FIG. 2 is a sectional, elevational view of tension roller 10, although a roller with the described structure may be employed for other rollers shown in FIG. 1. Roller 10 comprises, in the embodiment, a central core 12, on which is mounted a set of discs, here each indicated as 20.

FIG. 3 is a sectional, perspective view of a single disc 20 in isolation. A disc 20, in this embodiment, is made of a single piece of a material which exhibits flexible or resilient properties, such as plastic or rubber. The disc defines a rim 22 which defines a circumferential surface 24. There is further defined what is here called a "main portion" 26, and a center portion 28, the inner surface 30 of which contacts the central core 12 such as shown in FIG. 2. The rim 22 defines a first thickness, indicated as T, which is here the maximum thickness of the disc 20. The main portion 26 defines a second thickness that is less than the first thickness. The center portion 28 has a thickness equal to the first thickness T. In the context of a xerographic printer having a photoreceptor belt width of eleven to fourteen inches, a typical range of thickness T is between 3 and 5 mm. For main portion 26, a typical a typical range of thickness is between 1.5 and 2.5 mm, or about one-half to two-thirds of thickness T.

In this embodiment, the main portion 26 is centered along the thickness T of the rim 22 and the center portion 28, thus forming an "I-beam" profile along a radius of disc 20. However, it is possible to provide a disc having one or more tapered or curved surfaces between circumferential surface 22 and inner surface 30, and such variations can still be said to define a rim (even of negligible size) and main portion. Although the sides of main portion 26 are generally smooth and parallel as shown in FIG. 3, there may further be provided vanes, openings, or other variations to the basic shape of main portion 26; in a practical embodiment, however, at least a significant portion of main portion 26 has an effective thickness less than T.

When a set of discs 20 are mounted on a central core 12, as shown in FIG. 2, the roller 10 is formed. The circumferential surfaces 22 of each of a plurality of discs 20 form an effectively continuous outer surface of roller 10, as if roller 10 were a single-piece roller. There are, in this embodiment, appreciable spaces between the main portions 26 of adjacent discs 20 along roller 10. These spaces permit a small degree of deformation of individual discs 20, as would be caused by lateral motion of a belt entrained on the roller 10.

The overall construction of the roller 10, in the context of xerographic printing such as in FIG. 1, enables stabilization of the moving belt 100 by resisting lateral motion of the belt 100, much in the manner of the roller described in the '480 patent cited above. The roller 10 provides a further practical advantage in that the substantially continuous surface provided by the outer surfaces of adjacent discs 20 forms a substantially uniform heat sink along the length of roller 10, enabling heat to be distributed evenly along the roller 10 with minimal variations in temperature along the width of the belt 100. Also, when a roller such as 10 is used as a drive roller, such as 102 in FIG. 1, to drive the belt 100, the increase in surface area between the drive roller 102 and the belt 100 (compared to the roller in the '480 patent) provides an improvement in performance.

In the specific context where distributing heat to obtain a uniform temperature along the length of the roller is desirable, adjacent discs 20 along roller 10 must be close enough to obtain a uniform level of heat distribution along the roller 10. In the illustrated embodiment, the rims 22 of adjacent discs 20 contact each other, but direct, no-gap contact between discs 20 may not always be necessary, and mere "substantial contact," with a small gap, may be sufficient in some applications, especially when a certain degree of deformability of one or more discs 20 is desirable.

In the illustrated context of a roller in use with an imaging belt in a printing apparatus, a desired amount of flexibility is provided by a roller 10 in which at least the main portion 26 of each disc is of a hardness of shore A 30 to shore A 70, and typically about shore A 50.

Depending on a specific application, one or more discs 20 may be rigidly or somewhat rotatably mounted on central core 12. To maintain the discs 20 rigidly on the central core, the diameters of the inner surface 30 of each disc 20 can be made smaller than the outer diameter of central core 12, allowing the resilience of the disc against the central core 12 to maintain the disc rigidly in place. Alternately, central core 12 can be keyed in cross-section, corresponding to a keyed surface (not shown) of the inner surface 30 of each disc 20.

Although the illustrated discs 20 are shown as one-piece items, it is conceivable to make each disc 20 out of multiple pieces, such as providing a rigid rim 22 and/or center portion 28 and a relatively flexible main portion 26. It is also possible to assemble a roller 10 without a central core 12, such as by providing a suitable structure (not shown) at the center of each disc 20.

The circumferential surface 24 of each disc 20 forms a complete circle in the illustrated embodiment, but in some applications could define ridges, gaps, grooves, flat sides, or other discontinuities while still being substantially circular. A special coating of any kind, for any purpose, may be provided on the circumferential surface 24 of each disc 20.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A roller comprising:

a plurality of discs, each disc defining a circumferential surface, a rim having a first thickness, and a flexible main portion, the main portion effectively having a thickness, the second thickness being less than the first thickness, the circumferential surface of each disc having a thickness of between 3 and 5 mm;

the circumferential surfaces of a plurality of discs forming a substantially continuous surface.

2. The roller of claim 1, the main portion and rim of each disc being formed from a single piece.

3. The roller of claim 1, each disc further defining a center portion having a third thickness, the third thickness being approximately equal to the first thickness.

4. The roller of claim 3, the rim, main portion, and center portion of at least one disc forming an I-beam profile through a radius.

5. The roller of claim 1, the substantially continuous surface providing a substantially uniform heat sink along a length of the roller.

6. The roller of claim 1, further comprising a central core.

7. The roller of claim 6, at least one disc being rigidly mounted on the central core.

8. The roller of claim 6, the central core being substantially cylindrical.

9. The roller of claim 6, each disc forming an inner surface that is smaller than a diameter of the central core.

10. The roller of claim 1, a substantial portion of the main portion having a thickness of between one-half and two-thirds the thickness of the circumferential surface.

11. The roller of claim 1, the main portion having an effective durometer of shore A30 to shore A70.

12. A printing apparatus, comprising:

a belt suitable for carrying marking material in imagewise fashion;

at least a first roller supporting the belt, the first roller including a plurality of discs, each disc defining a circumferential surface and a flexible main portion, the main portion of each disc having a second thickness, the second thickness being less than the first thickness, the circumferential surface of each disc having a thickness of between 3 and 5 mm, the circumferential surfaces of a plurality of discs forming a substantially continuous surface.

13. The apparatus of claim 12, the rim, main portion, and center portion of at least one disc forming an I-beam.

14. The apparatus of claim 12, the belt being a charge receptor.

15. The apparatus of claim 12, further comprising a development station for applying marking material to the belt.

16. The apparatus of claim 12, further comprising an exposure station for exposing light onto the belt.

17. The apparatus of claim 12, the substantially continuous surface of the roller providing a substantially uniform heat sink along a length of the roller.

* * * * *